US007260894B2

(12) United States Patent
Zammitto

(10) Patent No.: US 7,260,894 B2
(45) Date of Patent: Aug. 28, 2007

(54) SCISSOR APPARATUS AND METHOD OF USING THEREOF

(76) Inventor: Carmelo Zammitto, 31 Tamar Dr., Medford, MA (US) 02155

( * ) Notice: Subject to any disclaimer, the term of this patent is extended or adjusted under 35 U.S.C. 154(b) by 18 days.

(21) Appl. No.: 10/981,389

(22) Filed: Nov. 4, 2004

(65) Prior Publication Data

US 2005/0120565 A1 Jun. 9, 2005

Related U.S. Application Data

(60) Provisional application No. 60/517,206, filed on Nov. 4, 2003.

(51) Int. Cl.
*B26B 13/20* (2006.01)

(52) U.S. Cl. ..... 30/232; 30/341

(58) Field of Classification Search ..... 30/232, 30/262, 341; D8/57, 107
See application file for complete search history.

(56) References Cited

U.S. PATENT DOCUMENTS

| | | | | | |
|---|---|---|---|---|---|
| 89,364 | A * | 4/1869 | Wendt | 30/341 |
| 95,834 | A * | 10/1869 | Price | 7/131 |
| 154,637 | A * | 9/1874 | Breeden | 30/262 |
| 176,519 | A * | 4/1876 | Does | 30/262 |
| 187,713 | A * | 2/1877 | Kelly | 30/256 |
| 430,677 | A * | 6/1890 | Pearsall | 30/341 |
| 927,058 | A * | 7/1909 | Krouse | 30/341 |
| 1,103,710 | A * | 7/1914 | Tourjee | 30/341 |
| 2,708,311 | A * | 5/1955 | McCloud | 30/120 |
| 3,825,020 | A * | 7/1974 | Myers | 132/200 |
| 3,846,910 | A * | 11/1974 | Davis | 30/271 |
| 4,744,147 | A * | 5/1988 | Modin | 30/254 |
| 5,060,381 | A * | 10/1991 | Taberlet | 30/232 |
| 5,109,608 | A * | 5/1992 | Pracht | 30/341 |
| 5,722,171 | A * | 3/1998 | Schmidt | 30/255 |
| 6,212,780 | B1 * | 4/2001 | Huang | 30/232 |
| D453,459 | S * | 2/2002 | Abubo et al. | D8/57 |
| 2005/0005456 | A1 * | 1/2005 | Wang et al. | 30/232 |

* cited by examiner

*Primary Examiner*—Hwai-Siu Payer
(74) *Attorney, Agent, or Firm*—Devine, Millimet & Branch, P.A.; Paul C. Remus; Raymond I. Bruttomesso, Jr.

(57) ABSTRACT

A scissor apparatus including a first section and a second section pivotably connected to each other. Both the first section and the second section have a blade end and a handle end. The scissors also include a stop member attached to the handle end of the first section and a rotation assembly on the first section. The rotation assembly attaches the handle end to the blade end. The rotation assembly allows the handle end to be rotated into at least two positions. A method of using the scissors apparatus, the method including the steps of holding a portion of hair to be thinned, and running an open pair of scissors through the hair portion, wherein the scissors are locked in a rigid, open position by a stop mechanism.

7 Claims, 9 Drawing Sheets

SCISSOR APPARATUS AND METHOD OF USING THEREOF

CROSS REFERENCE TO RELATED APPLICATIONS

The present application claims the benefit of Provisional Patent Application Ser. No. 60/517,206 filed Nov. 4, 2003, which is incorporated herein by reference.

TECHNICAL FIELD

The present invention relates to scissor apparatus and more particularly, to a scissor apparatus and a method of using thereof.

BACKGROUND INFORMATION

Hairdressers currently have a myriad of techniques for thinning out or reducing the thickness of hair when providing a haircut. One such method is called channeling. Channeling normally involves taking a razor blade and running it along the path in the hair from the front of the head to the back of the head. Channeling using this technique results in thin long stretches of very short hair between equally long stretches of hair cut to the desired length. The problem with this technique is that the hair left at the desired length lacks strength and balance due to lack of support from the channels of very short hair. Further, when channels of short hair begin to grow out, they help push the hair, which has previously been cut to the desired length, out resulting in an undesirable appearance.

Accordingly, there is a need for a scissor apparatus and a method of using the scissor apparatus as a channeling scissor that can produce a hair channel that provides support to the surrounding hair and does not diminish the appearance of the hair as it grow out

SUMMARY

In accordance with one aspect of the present invention a scissor apparatus including a a first section and a second section pivotably connected to each other. Both the first section and the second section have a blade end and a handle end. The scissors also include a stop member attached to the handle end of the first section and a rotation assembly on the first section. The rotation assembly attaches the handle end to the blade end. The rotation assembly allows the handle end to be rotated into at least two positions.

Some aspects of this embodiment may include one of more of the following. Where the rotation assembly includes a female gear on the handle end having plurality of gears and a male gear on the blade end. The female gear has a predetermined configuration such that it matably attaches to the male gear. This embodiment also includes a mechanism for changing the location of the female gear in relation to the male gear. The mechanism locks the female gear into a gear position and allows for rotation of the female gear relative to the male gear.

Other aspects of this embodiment may include one or more of the following: a second member attached to the second section handle; where the second section handle end further includes at least one bumper; and where the at least one bumper is made of rubber.

In accordance with one aspect of the present invention, a scissor apparatus including a first section and a second section pivotably connected each other. The first section and said second section each have a blade end and a handle end. A stop mechanism is attached to one of the handle ends. The stop mechanism has at least two positions, a first position and a second position, whereby when the stop mechanism is in the first position, the first section and the second section are locked in an open position.

Some aspects of this embodiment may include one of more of the following: where the second section handle end further includes at least one bumper; where the bumper is made from rubber; wherein the stop mechanism is an arm member pivotably attached to one of the handle ends; where the scissor also includes a second member attached to the second section handle; where the stop mechanism is a stop member attached to the handle end of the first section; where the scissor also includes a rotation assembly on the first section attaching the handle end to the blade end, and where the rotation assembly allows the handle end to be rotated into at least two positions.

Some aspects of this embodiment may include one of more of the following. Where the rotation assembly further includes a female part on the handle end and a male part on the blade end. The female part is of a predetermined configuration such that the male part matably attaches to the female part. Also, a mechanism for changing the location of the female part in relation to the male part. The mechanism locks the female part into a position and allows for rotation of the female part relative to the male part, whereby the rotation changes the location of the stop member. The scissor apparatus may also include a spring and pin assembly.

Some aspects of this embodiment may include one of more of the following. Where the rotation assembly further includes a female gear on the handle end, the female gear having a plurality of gears. And, a male gear on the blade end, the male gear having a predetermined configuration such that the male gear matably attaches to the female gear. Also, a mechanism for changing the location of the female gear in relation to the male gear. The mechanism locks the female gear into a gear position and allows for rotation of the female gear relative to the male gear, whereby the rotation changes the location of said stop member. The mechanism may include a spring and pin assembly.

In accordance with one aspect of the present invention a method for thinning hair. The method includes steps of holding a portion of hair to be thinned, and running an open pair of scissors through the hair portion. The scissors are locked in a rigid, open position by a stop mechanism.

Some aspects of this embodiment may include one of more of the following. 18. Where the two blades of the open pair of scissors are locked open approximately ½ inch relative to one another. Where the step of running an open pair of scissors further includes channeling the hair wherein a hand holding the open pair of scissors is positioned palm up; wherein the step of running an open pair of scissors further comprising effelating the hair wherein a hand holding the open pair of scissors is positioned palm down; or wherein the step of running an open pair of scissors further includes sizing the hair wherein a hand holding the open pair of scissors is positioned at a forty-five degree angle relative to a horizontal plane.

These aspects of the invention are not meant to be exclusive and other features, aspects, and advantages of the present invention will be readily apparent to those of ordinary skill in the art when read in conjunction with the appended claims and accompanying drawings.

BRIEF DESCRIPTION OF THE DRAWINGS

These and other features and advantages of the present invention will be better understood by reading the following detailed description of preferred embodiments, taken together with the drawings wherein.

DETAILED DESCRIPTION OF PREFERRED EMBODIMENTS

Figure 1:
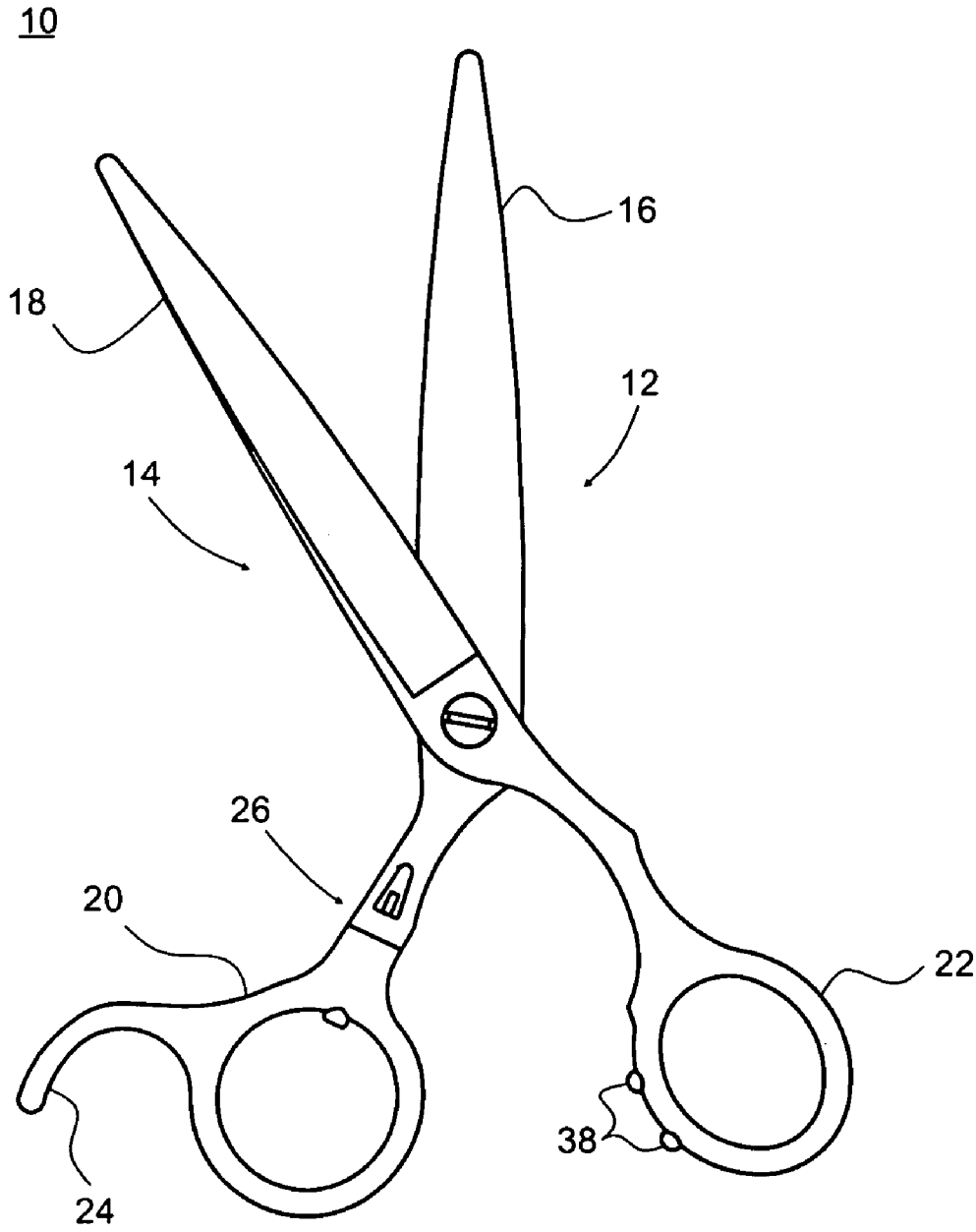
FIG. 1 is a front view of one embodiment of the present invention.

Referring first to FIG. 1, one embodiment of the present invention is shown. The scissor apparatus 10 includes a first section 12 and a second section 14. The first 12 and second 14 sections have a blade end 16,18 and a handle end 20,22. The first section 12 and the second section 14 are pivotable connected one to another by any method known and used in the art of scissors.

Figure 3:
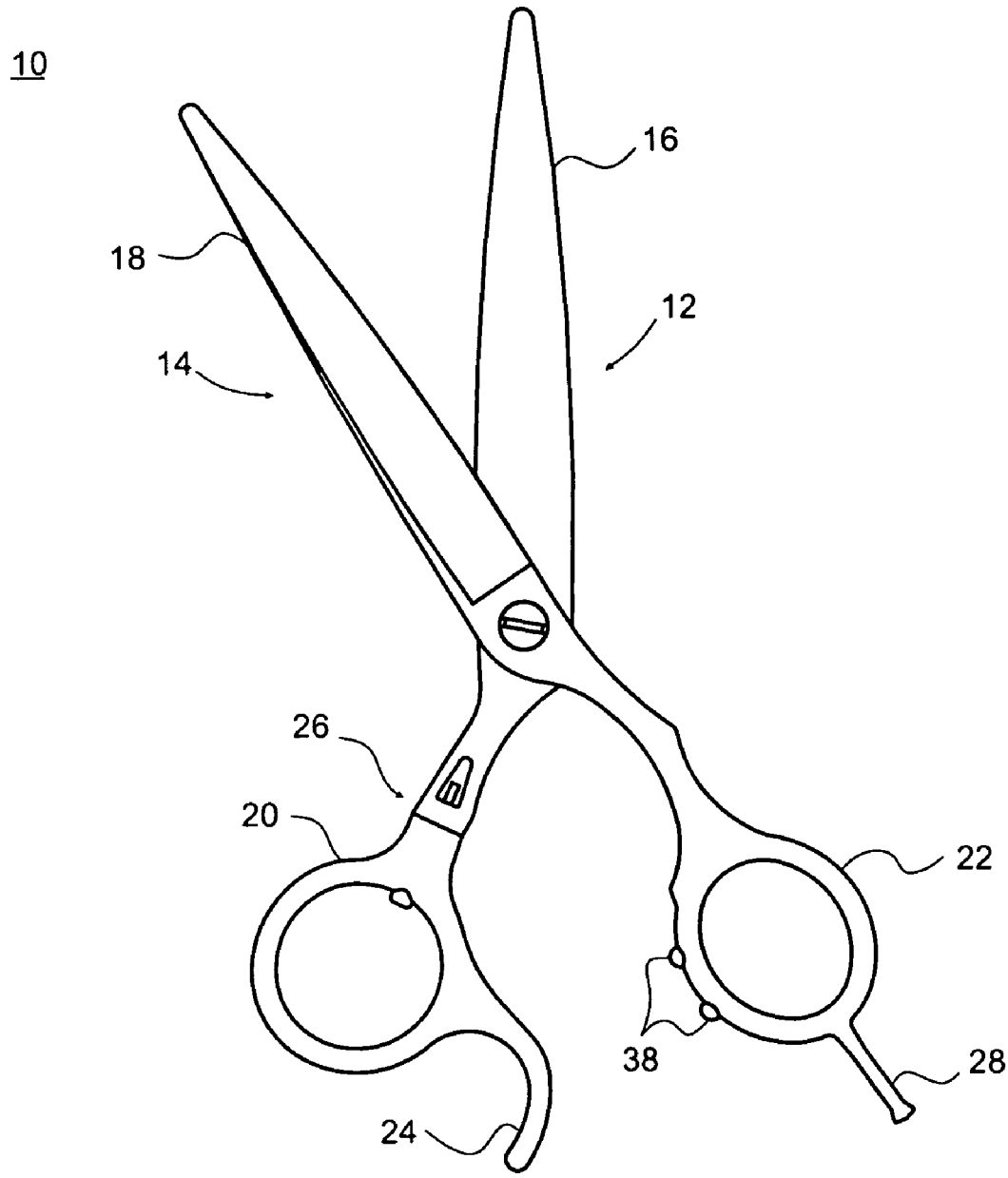
FIG. 3 is a front view of the alternate embodiment shown in FIG. 2 with the stop member in the first position.

A stop member 24 is attached to the handle end 20 of the first section 12. The stop member 24 can be of any shape known in the art. The purpose of the stop member 24 is to prevent the complete closing of the scissors 10 and to provide an ergonomic support to the scissor user. The stop member 24, when in the open position, prevents the first 12 and second 14 sections from becoming completely closed. As shown in FIG. 1, the stop member 24 is in a closed position, where the stop member 24 will not prevent the first 12 and second 14 sections from becoming completely closed. As shown in FIG. 3, the stop member 24 is in an open position, thus preventing the first 12 and second 14 sections from becoming completely closed.

The stop member 24 can be any dimension depending on the desired open position. Thus, if a more opened blade end 16,18 is desired, the stop member 24 will be longer. In the preferred embodiment, the stop member 24 is dimensioned such that it locks the scissors 10 in an open position with ½ inch between the first 12 and second 14 sections. The stop member 24 can also be used as a finger rest. Thus, the shape can be any shape, but the preferred embodiment is as shown in FIGS. 1 and 3 as this is ergonomic for a finger rest.

Still referring to FIG. 1, the preferred embodiment includes a rotation assembly on the first section 12. The rotation assembly 26 mates the handle end 20 with the blade end 16. The rotation assembly 26 allows for rotation of the handle end 20 about the vertical axis. The rotation assembly 26 therefore allows for the stop member 24 to change positions. This allows the stop member 24 to change angular position relative to the blade end 16.

Figure 2:
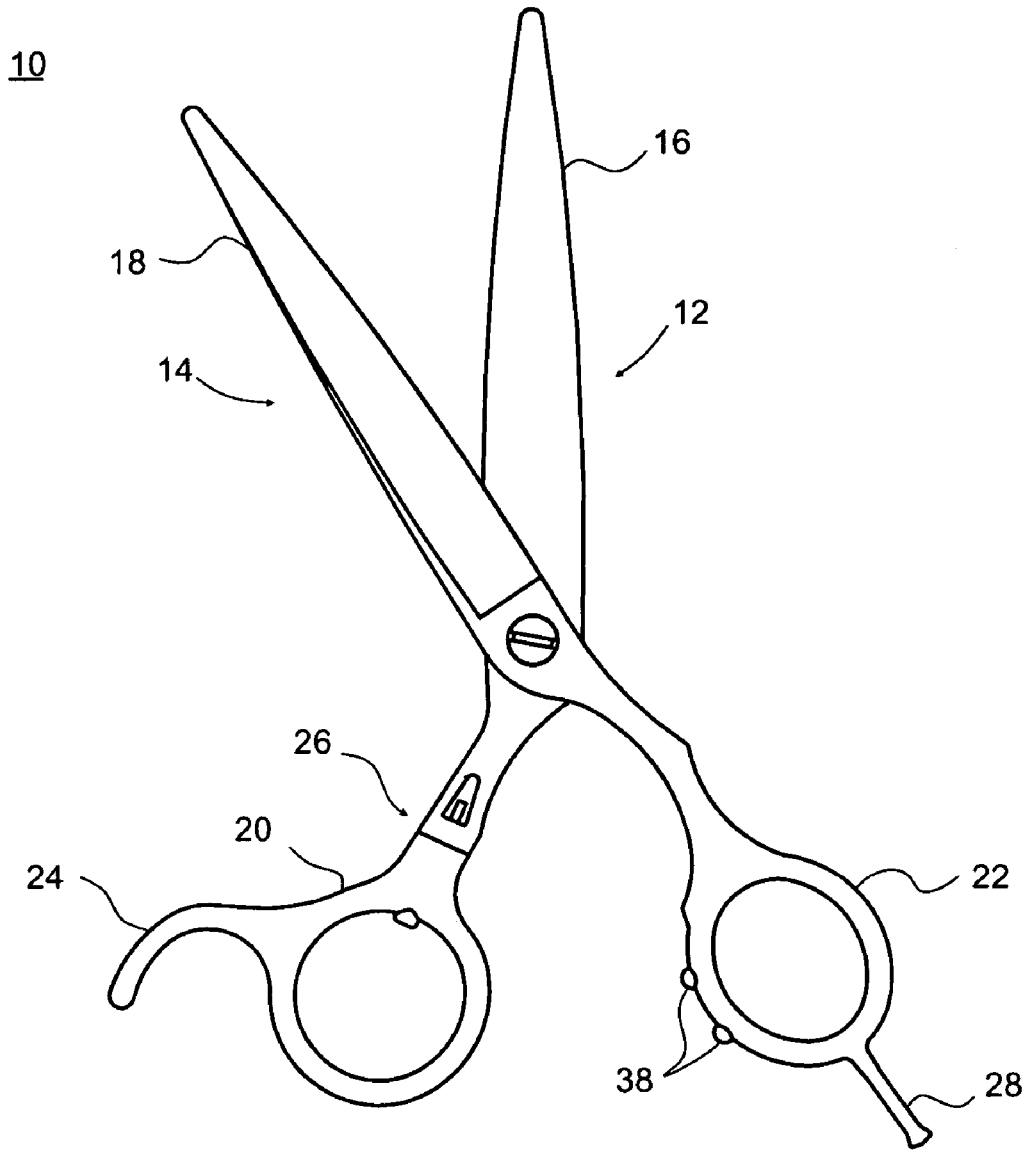
FIG. 2 is a front view of an alternate embodiment of the present invention with the stop member in the second position.

Referring next to FIGS. 2 and 3, in one embodiment, the scissors 10 include a second member 28 attached to the handle end 22 of the second section 14. The second member 28, in the preferred embodiment, is the shape shown in FIGS. 2 and 3. However, the second member could be any shape desired. The purpose of the second member 28 is as a finger rest for different positions of the scissors on a user's hand. However, the second member 28 can be designed to interlock and/or simply rest firmly against the stop member 24.

Figure 4:
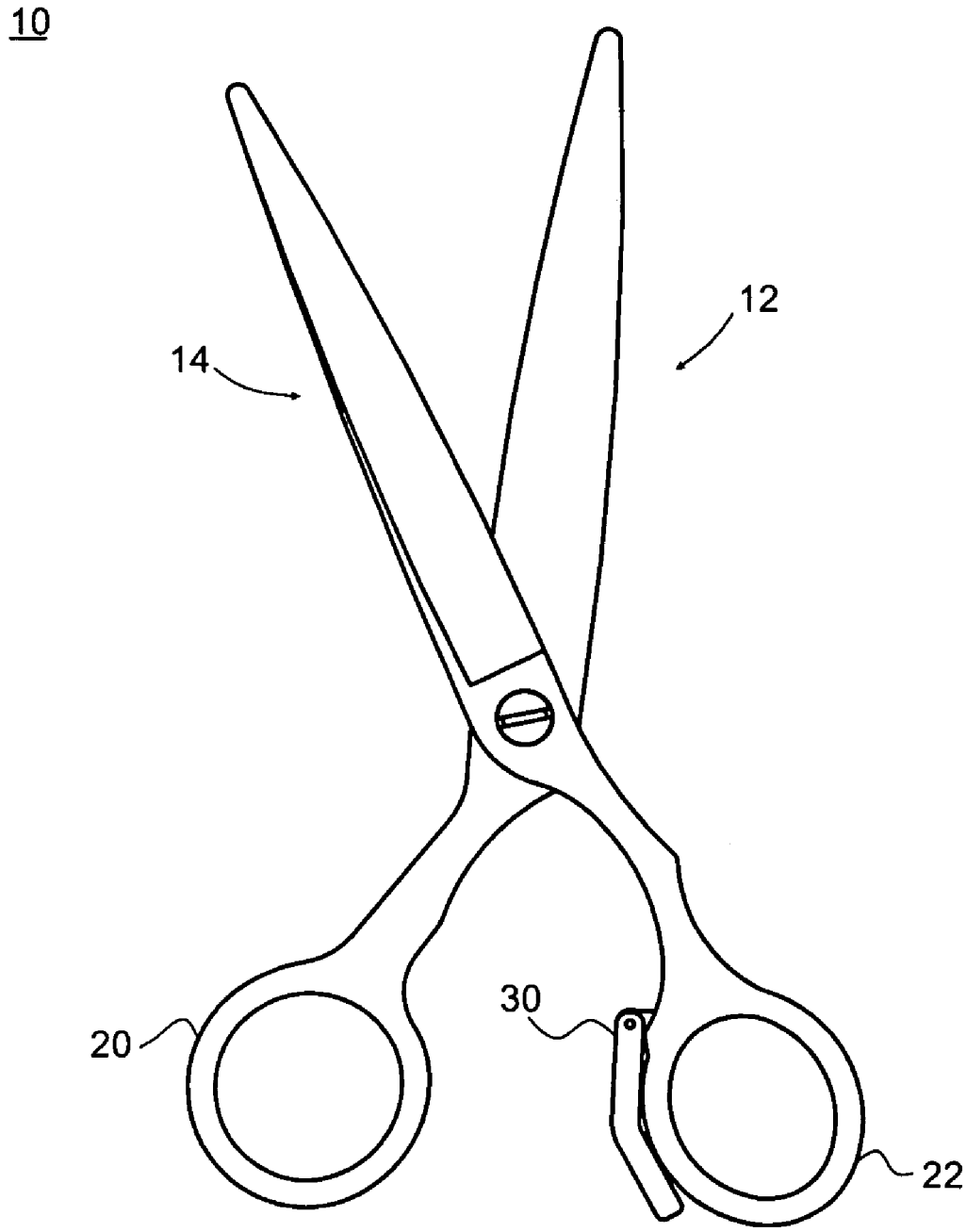
FIG. 4 is a front view of an alternate embodiment of the present invention with the arm member in the closed position.
Figure 5:
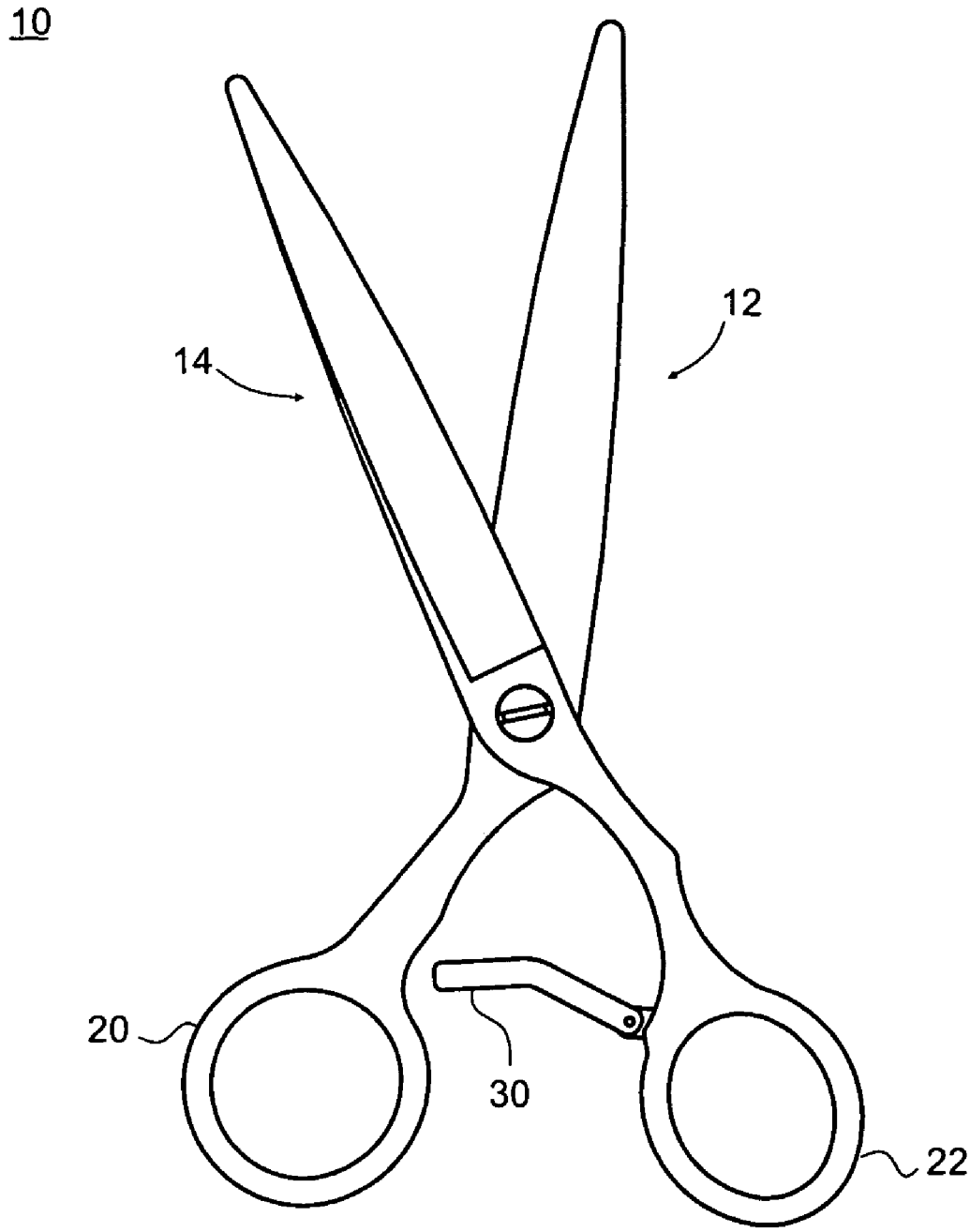
FIG. 5 is a front view of the alternate embodiment shown in FIG. 4 with the arm member in the open position.

Referring now to FIGS. 4 and 5, an alternate embodiment of the present invention is shown. Referring to both FIGS. 4 and 5, the alternate embodiment includes a stop mechanism 30 attached to either one of the handle ends. As shown in FIGS. 4 and 5, the stop mechanism 30 is attached to the handle end 22 of the second section 14. In alternate embodiments, the stop mechanism 30 is on either handle end 20,22. As shown in FIGS. 4 and 5, the stop mechanism 30 is pivotably attached to the handle end 22, allowing the stop mechanism 30 to move from the open position, shown in FIG. 4, to the closed position, shown in FIG. 5. The stop mechanism 30 can be any shape or size, depending on the needs of the user. The longer the stop mechanism 30, the further away the two sections 12,14 are from one another in the open position (shown in FIG. 5). As shown in FIG. 4, when in the closed position, the stop mechanism 30 pivots and folds against the handle 22. As shown in FIG. 5, when in the open position, the stop mechanism 30 rests against the opposing handle 20. This maintains the scissor 10 in the open position.

Other stop mechanisms are considered as alternate embodiments of the present invention. Any mechanism that prevents the two sections from closing is anticipated by this invention.

Figure 6B:
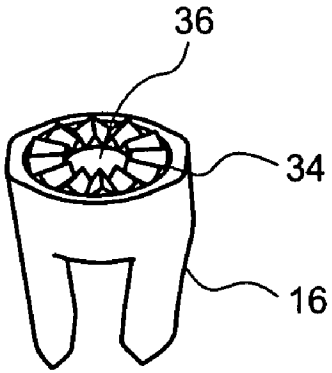
FIG. 6B is a partial view of the blade end of the first section and the female gear.
Figure 6A:
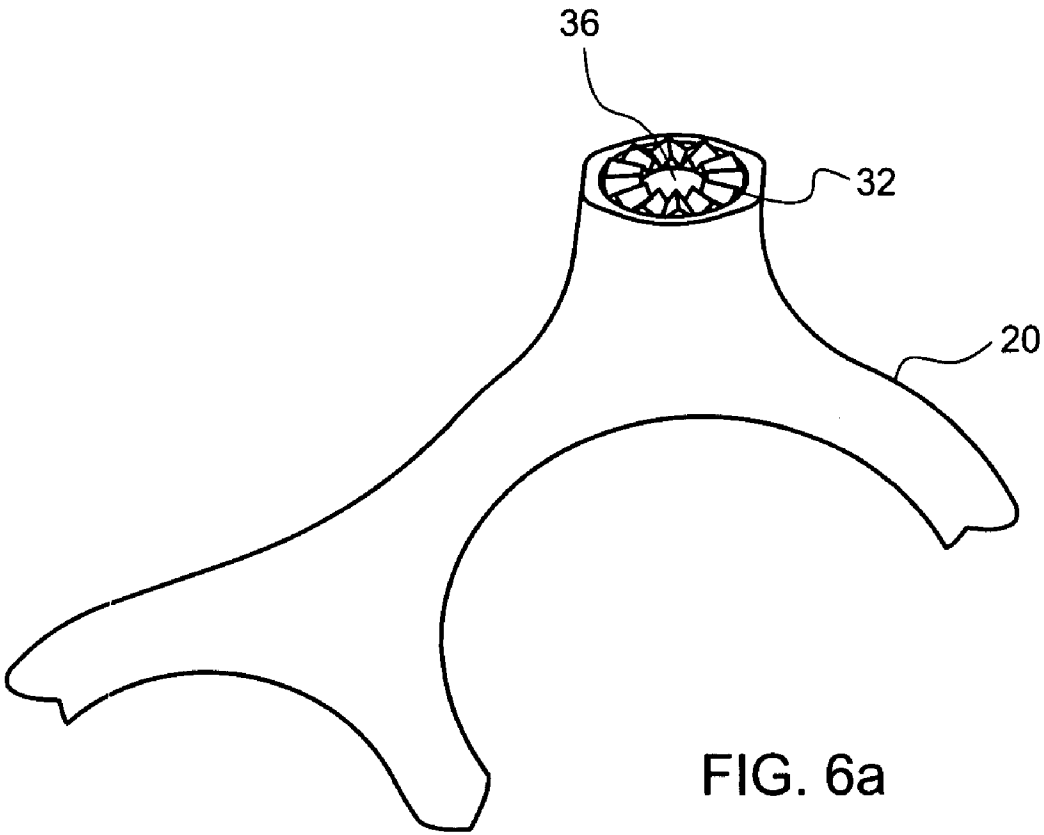
FIG. 6A is a partial view of the handle end of the first section and the male gear.

Referring next to FIGS. 6A and 6B, one embodiment of the rotation assembly is shown. In the preferred embodiment, the rotation assembly is a female gear 32 (FIG. 6A) and a male gear 34 (FIG. 6B). The female gear 32 and male gear 34, in the preferred embodiment, have a total of 12 gears in a 360° range. However, in other embodiments, the gears can have any number of gears greater than two. The number of gears dictates the number of positions where the stop mechanism (not shown) can be located.

Figure 6C:
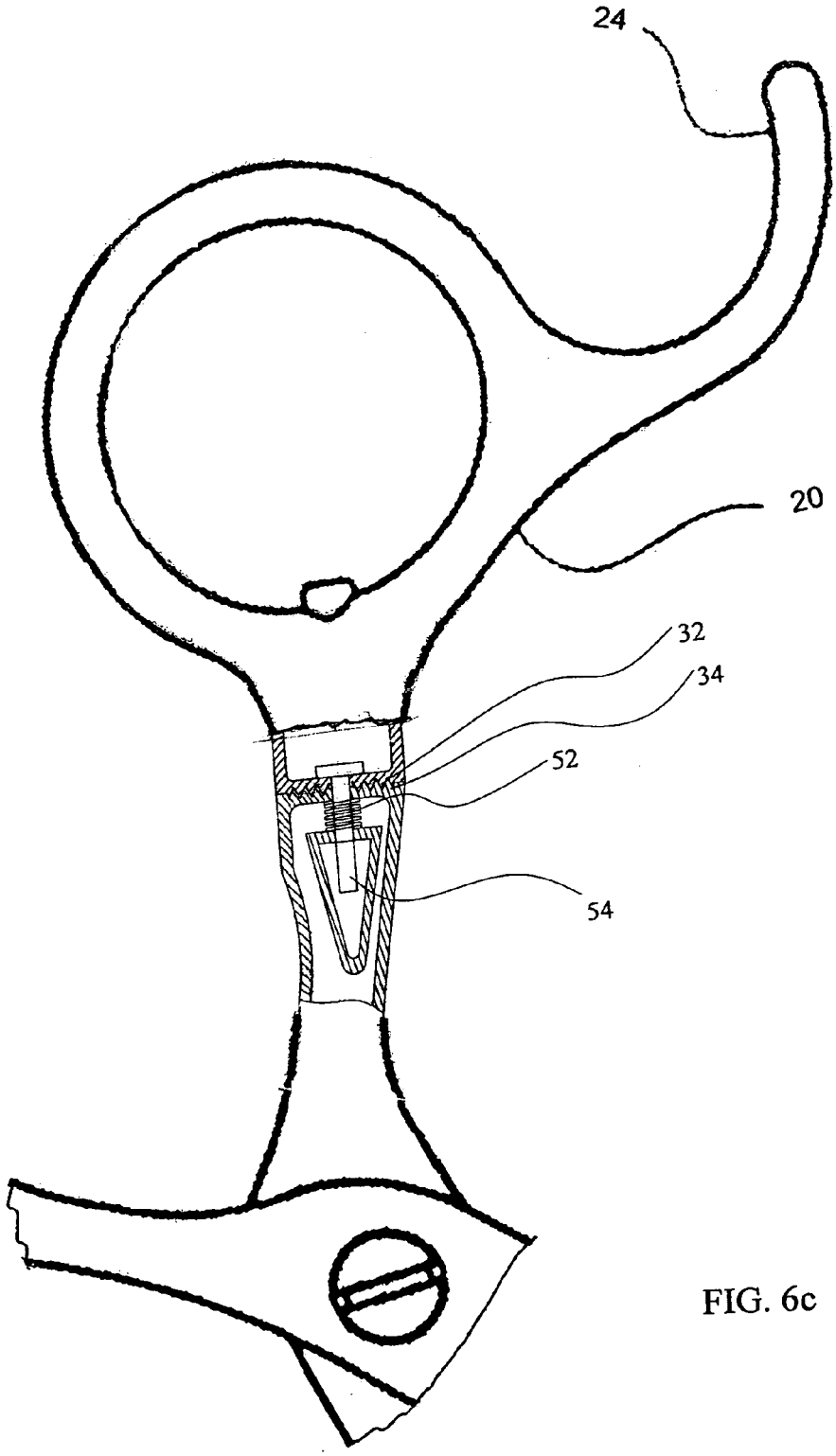
FIG. 6C is a broken out section of the handle end of one of the sections of the scissors with a portion to show the compression spring.

The female gear 32 and the male gear 34 are forced to mate by a mechanism for changing the location of the female gear 32 in relation to the male gear 34. This mechanism (not shown) can be any mechanism capable of allowing the gears 32, 34 to align, mate, and lock in mating position as well as rotate to change position. In one embodiment, the mechanism is a compression spring 52 aligned with a rotation pin 54 known and used in the art and shown in FIG. 6C. In another embodiment, the mechanism is a tension spring. The mechanism fits into the space 36 on the female 32 and male 34 gears or parts.

Figure 7B:
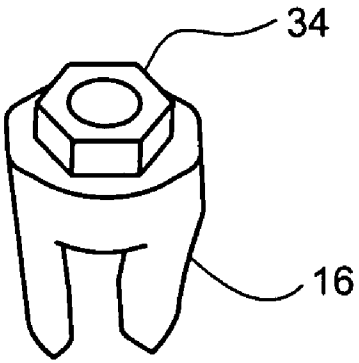
FIG. 7B is a partial view of the blade end of the first section and the female part.
Figure 7A:
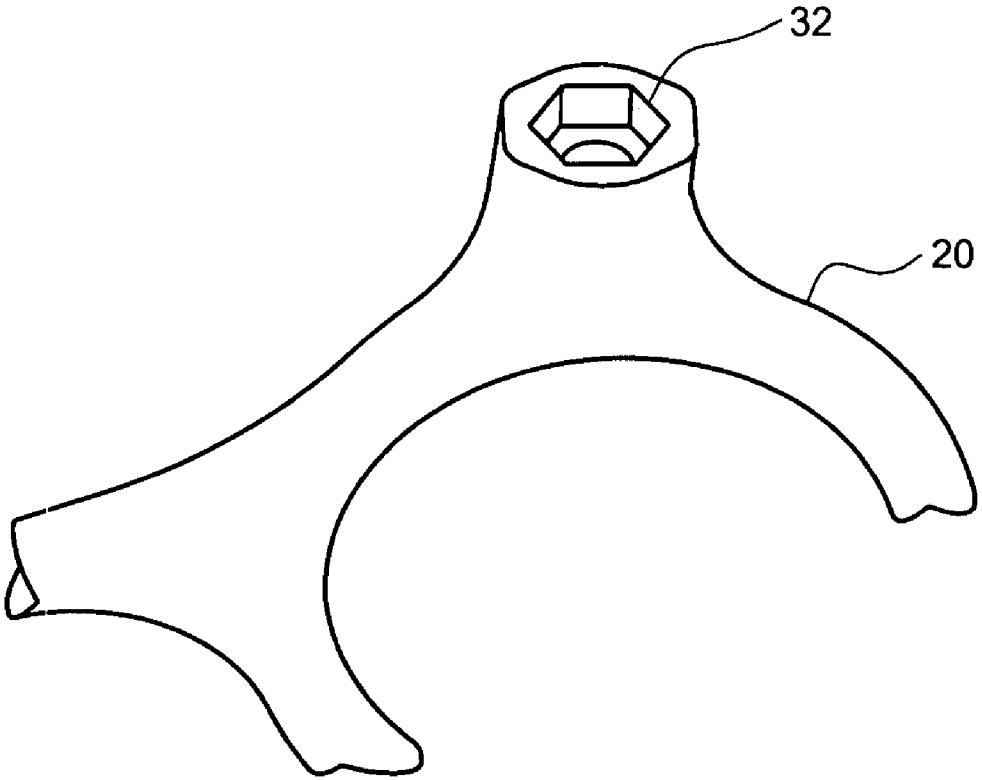
FIG. 7A is a partial view of the handle end of the first section and the male part.

Referring now to FIGS. 7A and 7B, an alternate embodiment of the mechanism is shown. In this embodiment, the female part 32 is a receptacle and the male part 34 is a boss. In one embodiment, the boss 34 is a square and the receptacle 32 a complement to the square. However, in alternate embodiments, the boss 32 could be any shape and the receptacle 32 its complement.

Referring again to FIGS. 1, 2, and 3, the handle end 22 can include at least one bumper 38. In the preferred embodiment, the handle end 22 includes at least two bumpers and the bumpers are made of rubber. However, in other embodiments, the bumpers 38 are made of any material known in the art. In still other embodiments, the handle end 22 does not include any bumpers 38. The bumper 38 prevents the two sections 12, 14 from pivoting beyond the closed position.

Figure 8:
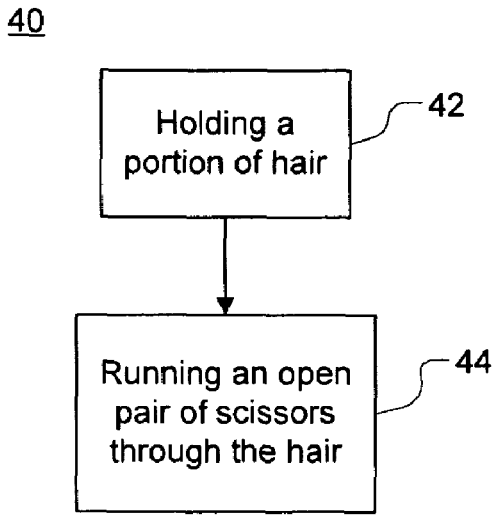
FIG. 8 is a flow diagram of one embodiment of the present method.

Referring to FIG. 8, the method of thinning hair 40 is shown. The prior art method of channeling hair involved holding a section of hair with one hand and, with the other hand, sliding a razor blade through the hair to remove a long thin section of the hair. The present invention utilizes a pair of open scissors instead of the razor. The method includes first, holding a portion of hair with one hand 42, and with the other hand, running an open pair of scissors through the hair portion, where the scissors are held in a rigid, open position. This method of channeling hair results in thinned hair with more strength and longer enduring aesthetic quality.

Figure 9:
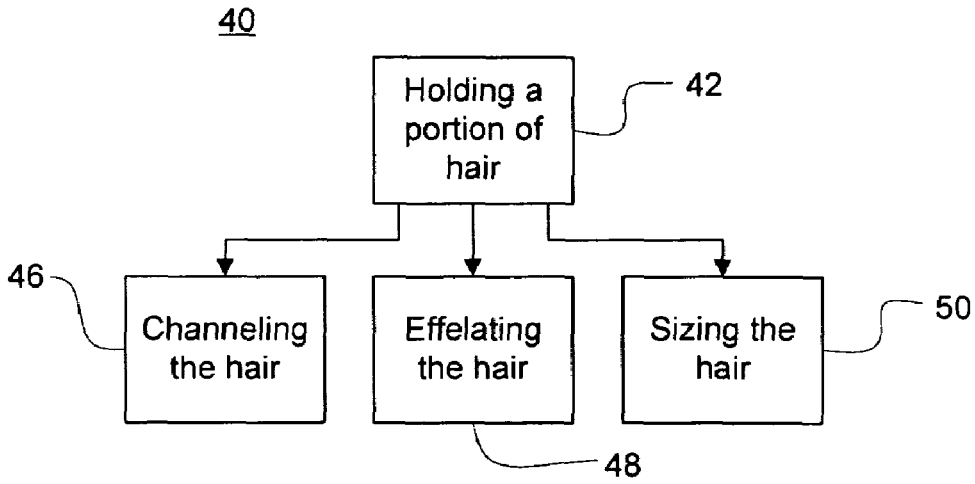
FIG. 9 is a flow diagram of multiple alternate embodiments of the present method.

Alternate embodiments of the method are shown in FIG. 9. One embodiment involves first, holding a portion of hair 42, then, channeling the hair 46 wherein a hand holding the scissors is positioned palm up while carrying out the step of running the open pair of scissors through the hair. Another embodiment involved first, holding a portion of hair 42, then, effelating the hair 48 wherein a hand holding the scissors is positioned palm down while carrying out the step of running the open pair of scissors through the hair. Still another embodiment of the invention involves first, holding a portion of hair 42, then, sizing the hair 50 wherein a hand holding the scissors is positioned palm down with the scissors held at a forty-five degree angle relative to a horizontal angle while carrying out the step of running the open pair of scissors through the hair. All of the methods include a preferred embodiment where the scissor is open by ½ inch. Other embodiments include where the scissor is open by less than ½ inch or more than ½ inch.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

The invention claimed is:

1. A scissor apparatus comprising:

a first section and a second section, said first section pivotably connected to said second section, said first section and said second section having a blade end and a handle end;

a rotation assembly on said first section attaching said handle end of the first section to said blade end of the first section, wherein said rotation assembly allows said handle end of the first section to be rotated into at least two positions;

a female gear carried on the first section;

a male gear carried on the first section, said male gear of a predetermined configuration such that said female gear matably attaches to said male gear, one of the gears carried by the handle end of the first section and the other gear carried by the blade end of the first section; and a mechanism for changing the location of said female gear in relation to said male gear, said mechanism locks said female gear into a gear position and allows for rotation of said female gear relative to said male gear; and a stop mechanism attached to the handle end of the first section, the stop mechanism having at least two positions, a first position and a second position, whereby when said stop mechanism is in said first position, the first section and the second section are positioned in an open position.

2. The scissor apparatus claimed in claim 1 further comprising a second member attached to said second section handle end.

3. The scissor apparatus claimed in claim 1 wherein said second section handle end further comprising at least one bumper.

4. The scissor apparatus claimed in claim 3 wherein said at least one bumper is made of rubber.

5. A scissor apparatus comprising:

a first section and a second section, the first section pivotably connected to the second section, the first section and the second section each having a blade end and a handle end;

a stop mechanism attached to the handle end of the first section, the stop mechanism having at least two positions, a first position and a second position, whereby when the stop mechanism is in the first position, the first section and the second section are maintained in an open position;

a rotation assembly on the first section attaching the handle end of the first section to the blade end of the first section, the rotation assembly having a female gear on said handle end of the first section, said female gear having a plurality of gears;

a male gear on said blade end of the first section, said male gear of a predetermined configuration such that said male gear matably attaches to said female gear; and a mechanism for changing the location of said female gear in relation to said male gear, said mechanism locks said female gear into a gear position and allows for rotation of said female gear relative to said male gear, wherein the rotation assembly allows the handle end of the first section to be rotated into at least two positions whereby said rotation changes the location of said stop mechanism.

6. The scissor apparatus claimed in claim 5 wherein said stop mechanism is an arm member pivotably attached to one of said handle ends.

7. The scissor apparatus claimed in claim 5 wherein said mechanism comprising a spring and pin assembly.

* * * * *